US009989032B2

(12) United States Patent
Uchida et al.

(10) Patent No.: US 9,989,032 B2
(45) Date of Patent: Jun. 5, 2018

(54) CONTROL DEVICE FOR SPARK IGNITION TYPE INTERNAL COMBUSTION ENGINE

(71) Applicants: DAIHATSU MOTOR CO., LTD., Ikeda-shi, Osaka (JP); IMAGINEERING, INC., Kobe-shi, Hyogo (JP)

(72) Inventors: Katsumi Uchida, Ikeda (JP); Yuta Shima, Ikeda (JP); Hiroaki Oi, Ikeda (JP); Akira Nakajima, Ikeda (JP); Takeshi Serizawa, Ikeda (JP); Yuji Ikeda, Kobe (JP)

( * ) Notice: Subject to any disclaimer, the term of this patent is extended or adjusted under 35 U.S.C. 154(b) by 0 days. days.

(21) Appl. No.: 14/355,046

(22) PCT Filed: Oct. 30, 2012

(86) PCT No.: PCT/JP2012/077952
§ 371 (c)(1),
(2) Date: Apr. 29, 2014

(87) PCT Pub. No.: WO2013/065659
PCT Pub. Date: May 10, 2013

(65) Prior Publication Data

US 2015/0027395 A1 Jan. 29, 2015

(30) Foreign Application Priority Data

Oct. 31, 2011 (JP) ..... 2011-239125

(51) Int. Cl.
*F02P 5/00* (2006.01)
*H01T 13/02* (2006.01)
(Continued)

(52) U.S. Cl.
CPC ..... *F02P 5/04* (2013.01); *F02M 27/042* (2013.01); *F02P 3/0407* (2013.01); *F02P 9/007* (2013.01);
(Continued)

(58) Field of Classification Search
CPC .. F02P 5/04; F02P 5/145; F02P 15/001; F02P 13/045; F02P 9/007; F02P 23/045;
(Continued)

(56) References Cited

U.S. PATENT DOCUMENTS 4,446,826 A * 5/1984 Kimura ..... F02P 23/045 123/143 B
2009/0031984 A1* 2/2009 Shiraishi ..... F02P 9/007 123/260

FOREIGN PATENT DOCUMENTS

JP 2000265934 * 3/1999
JP 2000-265934 A 9/2000
(Continued)

OTHER PUBLICATIONS

International Search Report, dated Feb. 5, 2013, issued in corresponding application No. PCT/JP2012/077952.

*Primary Examiner* — David Hamaoui
*Assistant Examiner* — Syed O Hasan
(74) *Attorney, Agent, or Firm* — Westerman, Hattori, Daniels & Adrian, LLP

(57) ABSTRACT

To alleviate or eliminate a problem of unburned fuel discharged to the outside of a cylinder in a case in which an air fuel mixture is insufficiently combusted in a combustion chamber. During the expansion stroke in which a high voltage is applied to an ignition plug via an ignition coil, and a spark discharge is caused to occur at the ignition plug, thereby the air fuel mixture in the combustion chamber is ignited and combusted, in a case in which deterioration of combustion state is detected, a microwave electric field is created in the combustion chamber prior to an opening timing of an exhaust valve at an end stage of the expansion stroke, thereby plasma is generated and enlarged in the combustion chamber.

2 Claims, 6 Drawing Sheets

(51) Int. Cl.

| | |
|---|---|
| ***F02P 3/02*** | (2006.01) |
| ***F02P 5/04*** | (2006.01) |
| ***F02P 9/00*** | (2006.01) |
| ***F02P 23/04*** | (2006.01) |
| ***F02M 27/04*** | (2006.01) |
| *F02P 3/04* | (2006.01) |
| *F02D 35/02* | (2006.01) |
| *F02P 17/12* | (2006.01) |
| *F02B 29/04* | (2006.01) |
| *F02M 26/05* | (2016.01) |
| *F02M 26/23* | (2016.01) |

(52) U.S. Cl.
CPC ..... *F02P 23/045* (2013.01); *F02B 29/0406* (2013.01); *F02D 35/021* (2013.01); *F02M 26/05* (2016.02); *F02M 26/23* (2016.02); *F02P 3/0442* (2013.01); *F02P 2017/125* (2013.01)

(58) Field of Classification Search
CPC ..... F02P 3/0442; F02M 27/042; F02M 26/05; F02M 26/23
USPC ..... 123/143 B, 536, 260, 169 R, 406.27, 123/146.5, 620; 701/101
See application file for complete search history.

(56) References Cited

FOREIGN PATENT DOCUMENTS

| | | | |
|---|---|---|---|
| JP | 2009281188 | * | 5/2008 |
| JP | 2009-036068 | A | 2/2009 |
| JP | 2009-281188 | A | 12/2009 |
| JP | 2010-101173 | A | 5/2010 |
| JP | 2011-064162 | A | 3/2011 |
| JP | 2011-132900 | A | 7/2011 |
| JP | 2011-159477 | A | 8/2011 |

* cited by examiner

CONTROL DEVICE FOR SPARK IGNITION TYPE INTERNAL COMBUSTION ENGINE

TECHNICAL FIELD

The present invention relates to a control device for controlling a spark ignition type internal combustion engine.

BACKGROUND ART

An ignition device mounted in a spark ignition type internal combustion engine causes a spark discharge and ignition to occur between a central electrode and a ground electrode of an ignition plug by applying a high voltage generated in an ignition coil when an igniter is turned off to the central electrode of the ignition plug.

Recently, in order to attain a stable flame by ensuring ignition of an air fuel mixture present in a combustion chamber of a cylinder, there is an attempt to perform an "active ignition" method of emitting a high frequency wave outputted from a high frequency oscillator or a microwave outputted from an electric field generation circuit, i.e., a magnetron, into the combustion chamber (see, for example, Japanese Unexamined Patent Application, Publication No. 2011-159477 and Japanese Unexamined Patent Application, Publication No. 2011-064162). According to the active ignition method, it is possible to create an electric field of a high frequency wave or a microwave in a space between a central electrode and a ground electrode, and enlarge plasma generated in the electric field to a large flame kernel followed by flame propagation combustion.

Meanwhile, in a case in which the air fuel mixture is insufficiently combusted resulting from the fact that the flame is weakened or the like in the process of combustion, a gas containing an unburned fuel component is exhausted from the cylinder to an exhaust passage, and reaches a three way catalyst for cleaning the exhaust gas. Consequently, there is a concern that a spontaneous ignition (after-fire) of the fuel component may occur in a high temperature part of the exhaust passage, or oxidization of the fuel component may occur in the catalyst, thereby excessively increasing the temperature of the catalyst and causing the catalyst to be melted.

PRIOR ART DOCUMENTS

Patent Documents

Patent Document 1: Japanese Unexamined Patent Application, Publication No. 2011-159477
Patent Document 2: Japanese Unexamined Patent Application, Publication No. 2011-064162

THE DISCLOSURE OF THE INVENTION

Problems to be Solved by the Invention

The present invention aims at alleviating or eliminating a problem of unburned fuel discharged to the outside of a cylinder in a case in which an air fuel mixture is insufficiently combusted in a combustion chamber.

Means for Solving the Problems

The present invention is directed to a control device of a spark ignition type internal combustion engine that applies a high voltage to an ignition plug via an ignition coil, and causes a spark discharge to occur at the ignition plug, thereby igniting and combusting an air fuel mixture in a combustion chamber, wherein, in a case in which deterioration of combustion state is detected, the control device generates an electric field of a high frequency wave or a microwave in the combustion chamber prior to an opening timing of an exhaust valve during the expansion stroke in a cycle (an intake-compression-expansion-exhaust cycle in a four stroke engine) in which the deterioration in combustion state has been detected.

This means that, the control device is configured such that, in a case in which the combustion becomes unstable resulting from the fact that the flame is weakened or the like after the middle stage of the expansion stroke, an electromagnetic wave is emitted to the combustion chamber to generate plasma, and thus, the combustion is promoted again in the same expansion stroke.

Effect of the Invention

According to the present invention, even in a case in which the combustion of the air fuel mixture in the combustion chamber becomes unstable, it is possible to sufficiently combust the fuel by enhancing the flame by means of plasma generation. Accordingly, the problem of unburned fuel discharged to the outside of the cylinder is alleviated or eliminated.

BEST MODE FOR CARRYING OUT THE INVENTION

Figure 1:
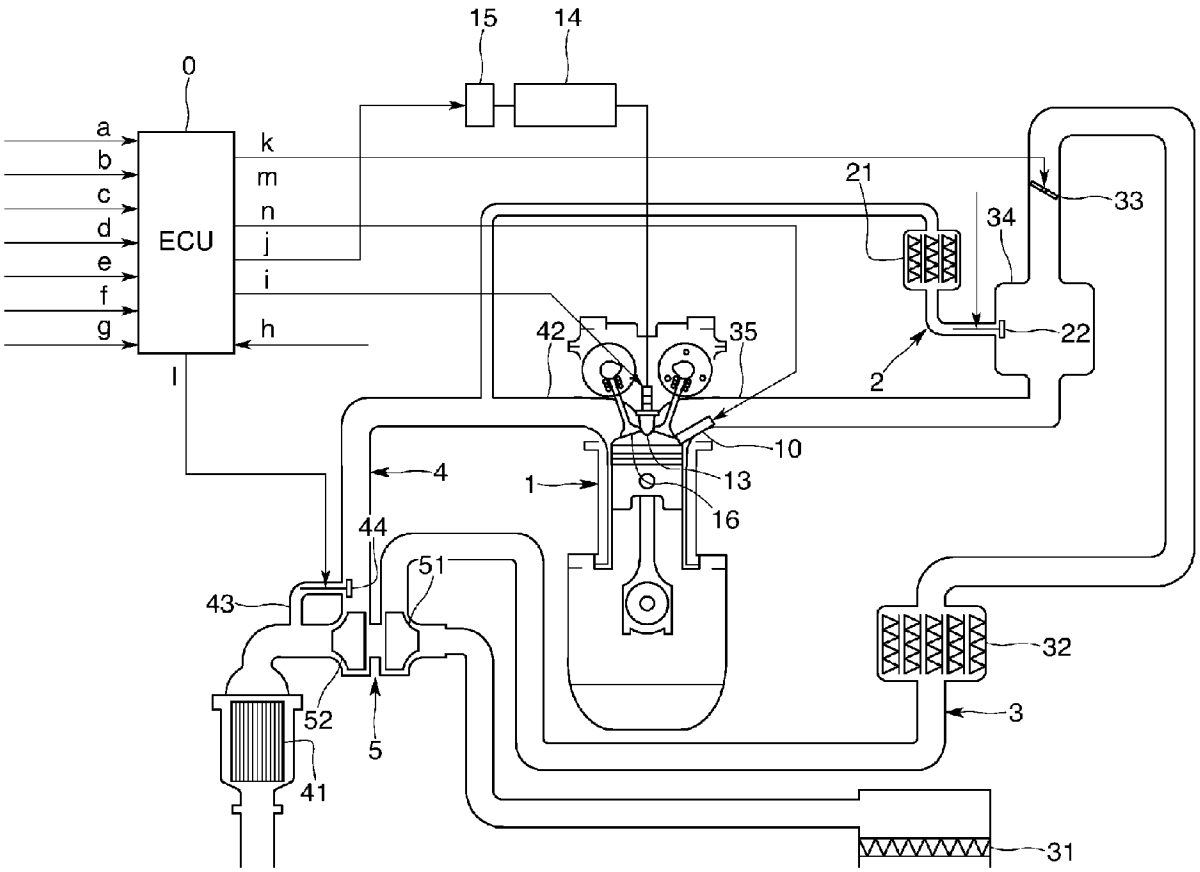
FIG. 1 is a schematic configuration diagram of an internal combustion engine and an electric field generation device according to an embodiment of the present invention.

In the following, a description will be given of an embodiment of the present invention with reference to the accompanying drawings. FIG. 1 shows an outline of an internal combustion engine for a vehicle according to the present embodiment. The internal combustion engine is of an in-cylinder direct injection type, and is provided with a plurality of cylinders 1 (only one cylinder is shown in FIG. 1), injectors 10 for injecting fuel to the respective cylinders 1, intake passages 3 for supplying intake gas to the respective cylinders 1, exhaust passages 4 for exhausting exhaust gas from the respective cylinders 1, exhaust turbo superchargers 5 that supercharge intake gas flowing through the respective intake passages 3, and outside EGR (Exhaust Gas Recirculation) devices 2 that reflux EGR gas from the respective exhaust passages 4 to the respective intake passages 3.

Figure 2:
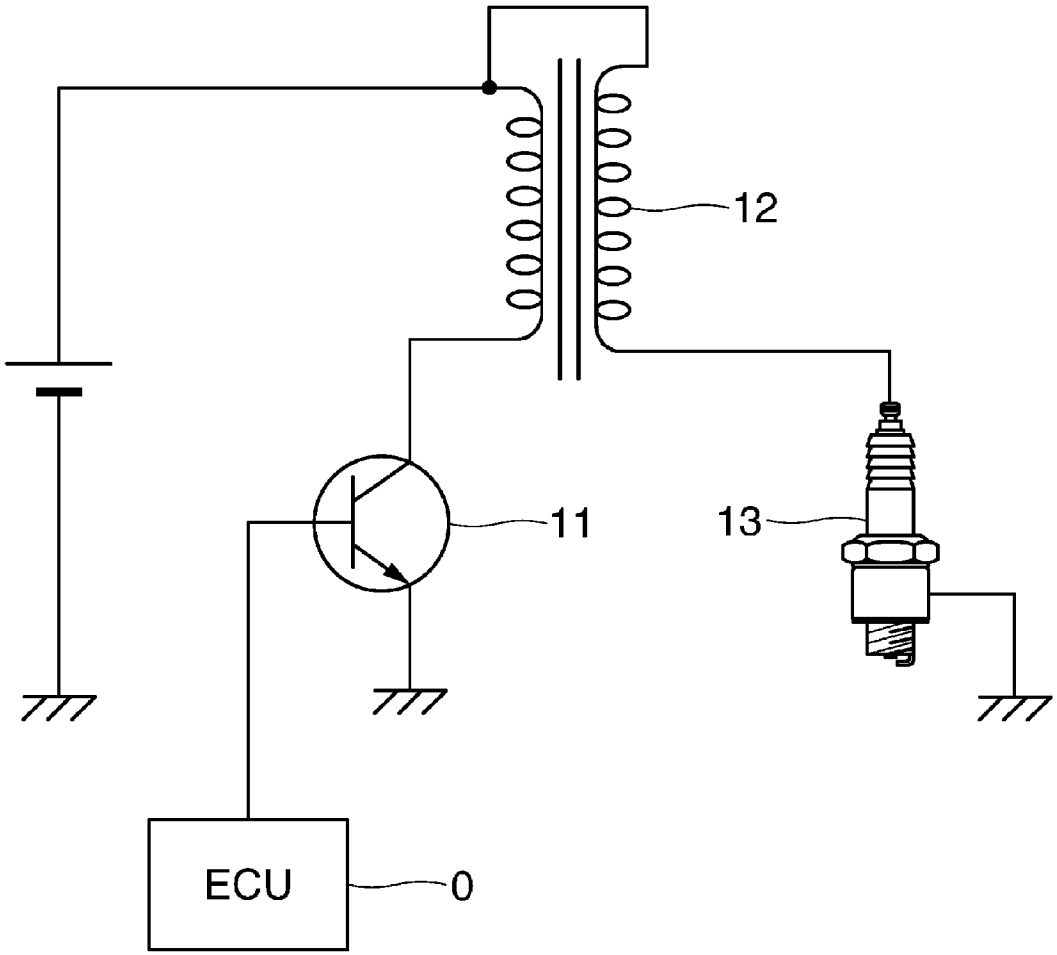
FIG. 2 is a circuit diagram of a spark ignition device according to the embodiment.

An ignition plug 13 is attached to a ceiling part of a combustion chamber of the cylinder 1. FIG. 2 shows an electric circuit for spark ignition. The ignition plug 13, when applied with an induction voltage generated in an ignition coil 12, causes a spark discharge to occur between a central electrode and a ground electrode. The ignition coil 12 is integrally incorporated in a coil case along with an igniter 11, which is a semiconductor switching element.

The igniter 11, upon receiving an ignition signal i from an ECU (Electronic Control Unit) 0 which is a control device of the internal combustion engine, turns on to allow an electric current to flow through a primary side of the ignition coil 12, and turns off to cut off the electric current at an ignition timing immediately thereafter. Then, a self-induction occurs and a high voltage is generated at the primary side. Consequently, an even higher induction voltage is generated at a secondary side, since the primary side and the secondary side share the same magnetic circuit and the same magnetic flux. The high induction voltage is applied to the central electrode of the ignition plug 13 to cause a spark discharge to occur between the central electrode and the ground electrode.

According to the present embodiment, a microwave generation device is provided as one type of the electric field generation device. The microwave generation device is provided with a magnetron 14 powered by a battery, and a control circuit 15 adapted to control the magnetron 14. The microwave generation device is electrically connected to the ignition plug 13 via a waveguide, a coaxial cable, or the like, and is capable of applying a microwave outputted from the magnetron 14 to the ignition plug 13 and emitting the microwave from the central electrode of the ignition plug 13 to the combustion chamber of the cylinder 1.

The microwave from the magnetron 14 is applied to the ignition plug 13 approximately simultaneously with, immediately before, or immediately after the initiation of the spark discharge. The microwave from the magnetron 14 and the high induction voltage from the ignition coil 12 may be superimposed with each other and applied to the central electrode of the ignition plug 13.

The intake passage 3 introduces air from the outside to an intake port of the cylinder 1. An air cleaner 31, a compressor 51 of the supercharger 5, an intercooler 32, an electronic throttle valve 33, a surge tank 34, and an intake manifold 35 are arranged on the intake passage 3 in this order from upstream.

The exhaust passage 4 introduces an exhaust gas produced as a result of fuel combustion in the cylinder 1 from an exhaust port of the cylinder 1 to outside. An exhaust manifold 42, a drive turbine 52 of the supercharger 5, and a three way catalyst 41 are arranged on the exhaust passage 4. Furthermore, an exhaust bypass passage 43 that bypasses the turbine 52, and a waste gate valve 44, which is a bypass valve for opening and closing an inlet of the bypass passage 43, are attached to the exhaust passage 4. The waste gate valve 44 is an electric waste gate valve operable to be opened and closed by inputting a control signal 1 to an actuator. ADC (Direct Current) servomotor is employed as the actuator.

The exhaust turbo supercharger 5 is configured such that the drive turbine 52 and the compressor 51 are coaxially coupled together so as to be interlocked with each other. The drive turbine 52 is driven to rotate byway of energy of the exhaust gas, and the rotation force causes the compressor 51 to perform pumping action, thereby compressing by pressure (supercharging) and thus feeding an intake air to the cylinder 1.

The outside EGR device 2 is adapted to implement so-called high pressure loop EGR. An inlet of an outside EGR passage is connected to the exhaust passage 4 at a predetermined position on the upstream side of the turbine 52. An outlet of the outside EGR passage is connected to the exhaust passage 3 at a predetermined position on the downstream side of the throttle valve 33, more particularly, to the surge tank 34. An EGR cooler 21 and an EGR valve 22 are arranged on the outside EGR passage.

The ECU 0 is a microcomputer system including a processor, a memory, an input interface, an output interface, and the like.

To the input interface are inputted a vehicle speed signal a outputted from a vehicle speed sensor for detecting a vehicle speed, an engine rotation signal b outputted from an engine rotation sensor for detecting an rotation angle of a crank shaft and an engine speed, an accelerator opening signal c outputted from an accelerator opening sensor for detecting a push-down amount of an accelerator pedal or an opening degree of the throttle valve 33 as an accelerator opening (i.e., a demand load), an intake temperature signal d outputted from a temperature sensor for detecting an intake temperature in the intake passage 3 (especially, in the surge tank 34), an intake pressure signal e outputted from a pressure sensor for detecting an intake pressure (or a supercharge pressure) in the intake passage 3 (especially, in the surge tank 34), a cooling water temperature signal f outputted from a water temperature sensor for detecting a cooling water temperature of the internal combustion engine, a cam signal g outputted from a cam angle sensor at a plurality of cam angles of an intake camshaft, anion current signal h outputted from a detection circuit for detecting an ion current produced as a result of plasma generation and air fuel mixture combustion in the combustion chamber, and the like. The engine rotation sensor outputs the pulse signal b every 10 CA (Crank Angle) degrees. The cam angle sensor outputs the pulse signal g every 720 CA degrees divided by a number of the cylinders (every 240 CA degrees in a case of three cylinder engine). In the detection circuit of the ion current according to the present embodiment, the ion current flowing through the ignition plug 13 is measured at a secondary side circuit of the ignition coil 12 (for example, as a secondary voltage generated at a secondary winding of the ignition coil 12, or at a connection end for connecting the microwave generation device with the ignition plug 13).

The output interface outputs an ignition signal i to the igniter 11, a microwave generation instruction signal j to the control circuit 15 of the magnetron 14, an opening degree operation signal k to the throttle valve 33, an opening degree operation signal l to the waste gate valve 44, an opening degree operation signal m to the EGR valve 22, a fuel injection signal n to the injector 10, and the like.

The processor of the ECU 0 interprets and executes a program stored in advance in the memory, and calculates operation parameters to control an operation of the internal combustion engine. The ECU 0 acquires via the input interface the pieces of information a, b, c, d, e, f, g, and h necessary for the operation control of the internal combustion engine so as to recognize the engine speed and estimate an intake air quantity filled in the cylinder 1. Based on the engine speed and the intake air quantity thus estimated, the ECU 0 determines the operation parameters such as a required fuel injection quantity, a fuel injection timing (including the number of times of fuel injections for each combustion), a fuel injection pressure, an ignition timing, whether or not a microwave electric field is to be created in the combustion chamber at the time of ignition, an EGR quantity (or an EGR rate), and an opening degree of the EGR valve 22. As specific methods for determining the operation parameters, those known in the art may be used, and therefore descriptions thereof are omitted. The ECU 0 outputs via the output interface the control signals i, j, k, l, m, and n corresponding to the operation parameters.

According to the present embodiment, during the expansion stroke in which the spark discharge is caused to occur at the ignition plug 13, and the air fuel mixture in the combustion chamber of the cylinder 1 is ignited (although the ignition itself occurs at an end stage of the compression stroke or at an initial stage of the expansion stroke) and combusted, in a case in which the deterioration of combustion state is detected after the middle stage of the expansion stroke, the combustion is promoted again by creating the microwave electric field in the combustion chamber during the same expansion stroke.

Figure 3:
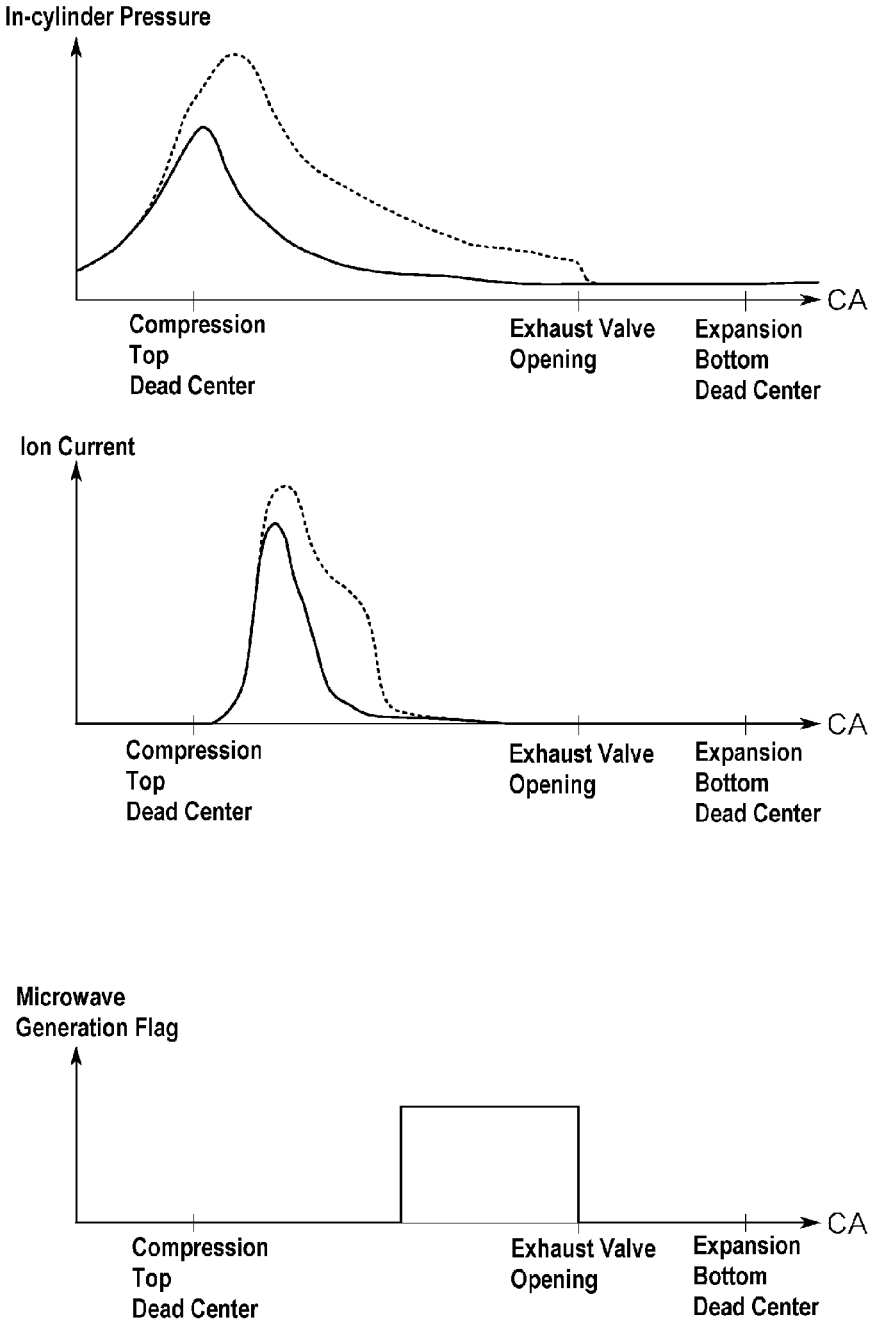
FIG. 3 is a timing chart showing transitions of an in-cylinder pressure and an ion current, and a flag of microwave generation in respective cases of normal combustion and unstable combustion according to the embodiment.

When the combustion state deteriorates in the combustion chamber of the cylinder 1, a value of the ion current produced therein decreases, and a time period in which the ion current flows also decreases in comparison with a case of normal combustion. FIG. 3 shows transitions of an in-cylinder pressure and the ion current during the expansion stroke. In FIG. 3, the broken lines indicate the transitions in a case of normal combustion, and the solid lines indicate the transitions in a case of unstable combustion.

The ECU 0 compares with respective reference threshold values the value of the ion current and/or the detection period in which the ion current is detected via the ignition plug 13 during the expansion stroke. In a case in which the value of the ion current is less than the reference threshold value and/or the detection period in which the ion current is detected is less than the reference threshold value, the ECU 0 determines that the combustion state has deteriorated, and, if it is prior to an opening timing of the exhaust valve 16, carries out a control of causing the microwave generation device to apply a microwave to the ignition plug 13 and to emit the microwave from the central electrode to the combustion chamber. Under this control, plasma is generated in the combustion chamber, and a flame is enhanced again. Accordingly, it is possible to sufficiently combust the air fuel mixture.

According to the present embodiment, during the expansion stroke in which the high voltage is applied to the ignition plug 13 via the ignition coil 12, and the spark discharge is caused to occur at the ignition plug 13, thereby the air fuel mixture in the combustion chamber is ignited and combusted, in a case in which the deterioration of combustion state is detected, the control device 0 of the internal combustion engine creates a microwave electric field in the combustion chamber prior to the opening timing of the exhaust valve 16 occurring at the end stage of the expansion stroke. Therefore, in a case in which the combustion becomes unstable resulting from the fact that the flame is weakened or the like after the middle stage of the expansion stroke, it is possible to emit an electromagnetic wave to the combustion chamber to generate and enlarge plasma, thereby promoting the combustion again during the same expansion stroke. Accordingly, it is possible to steadily reduce unburned fuel component emitted to the exhaust passage 4, thereby preventing the after-fire from occurring in the exhaust passage 4 and the catalyst 41 from being melted.

The present invention is not limited to the embodiment described in detail above. For example, in the embodiment described above, it has been described that, during the expansion stroke, the ion current flowing through the ignition plug 13 is detected to determine whether or not the combustion state has deteriorated. However, as long as a pressure sensor for measuring an in-cylinder pressure is provided in each cylinder 1, it is possible to detect the in-cylinder pressure and determine whether or not the combustion state has deteriorated based on whether the in-cylinder pressure is low or high, as shown in FIG. 3. This means that a method of detecting the deterioration of the combustion state is not unique.

Furthermore, the electric field generation device that generates an electric field in the combustion chamber for the purpose of plasma generation in the combustion chamber is not limited to the microwave generation device. The electric field generation device other than the microwave generation device may include an AC (Alternating Current) voltage generation device that outputs a high frequency AC voltage, a pulsating voltage generation device that outputs a high frequency pulsating voltage, and the like. In a case in which the pulsating voltage generation device is employed, any device may be applicable as long as the device generates a DC (Direct Current) voltage that periodically changes, and the voltage may have any waveform. The pulsating voltage includes a pulsed voltage that changes from a reference voltage (may be 0 volt) to a predetermined voltage at a predetermined cycle, a half-wave rectified AC voltage, a DC biased AC voltage, and the like. It is preferable that the high frequency voltage generated by the electric field generation device has a frequency in a range of approximately between 200 kHz and 1000 kHz and an amplitude in a range of approximately between 3 kV p-p (peak-to-peak) and 10 kV p-p.

Figure 4:
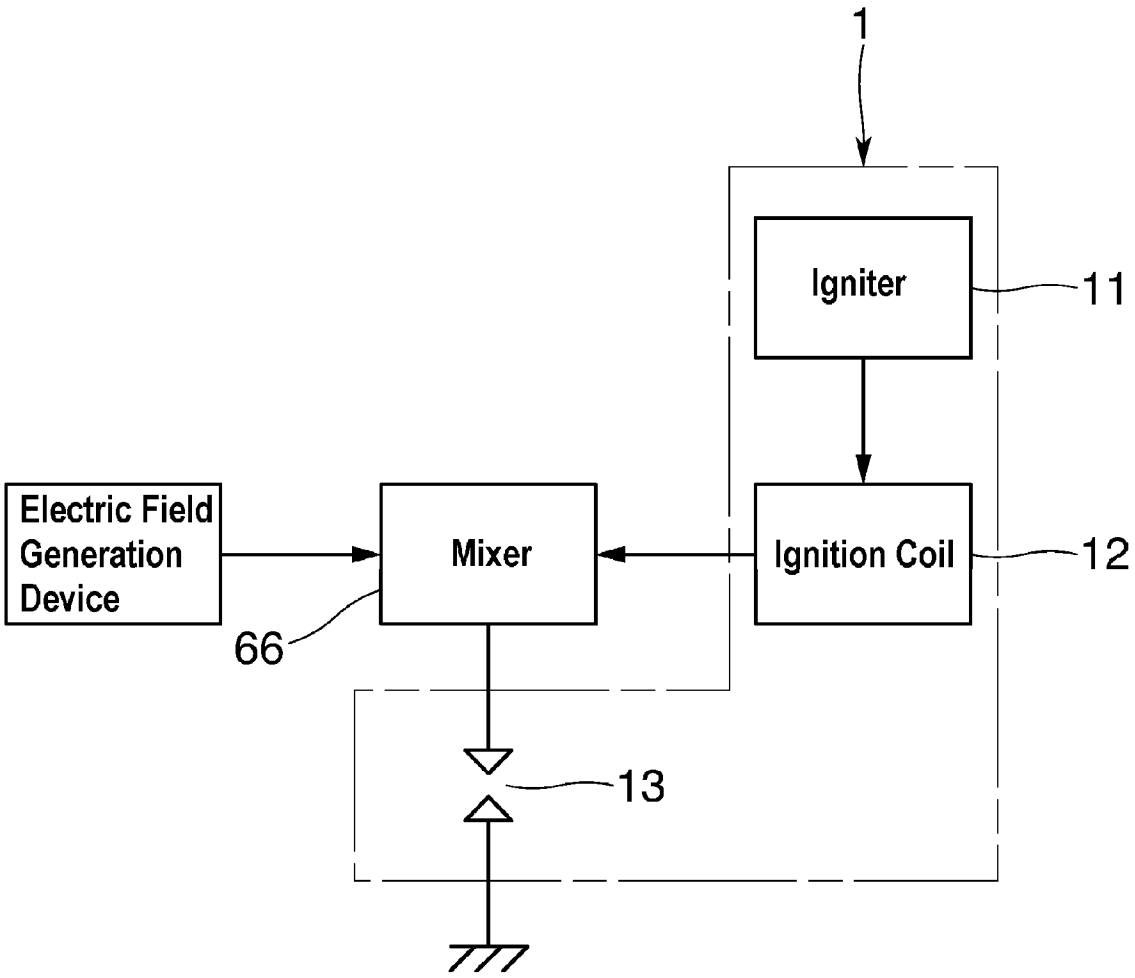
FIG. 4 is a schematic configuration diagram of an electric field generation device according to a modified example of the present invention.
Figure 5:
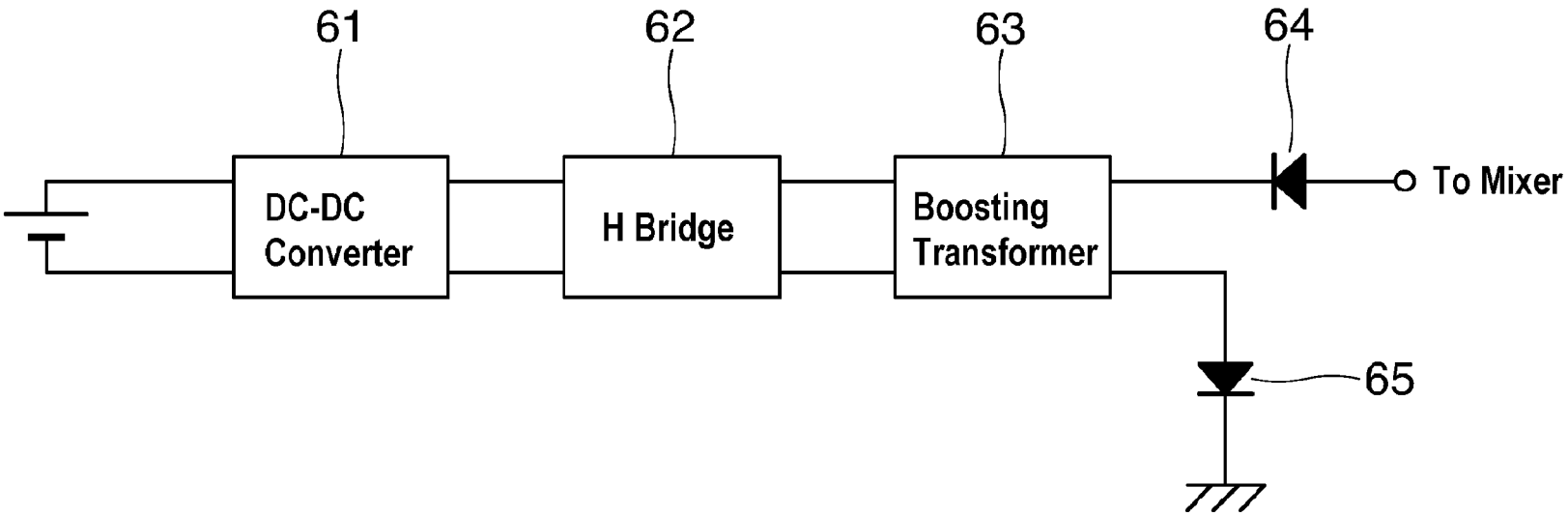
FIG. 5 is a diagram showing a specific configuration of the electric field generation device according to the modified example of the present invention.
Figure 6:
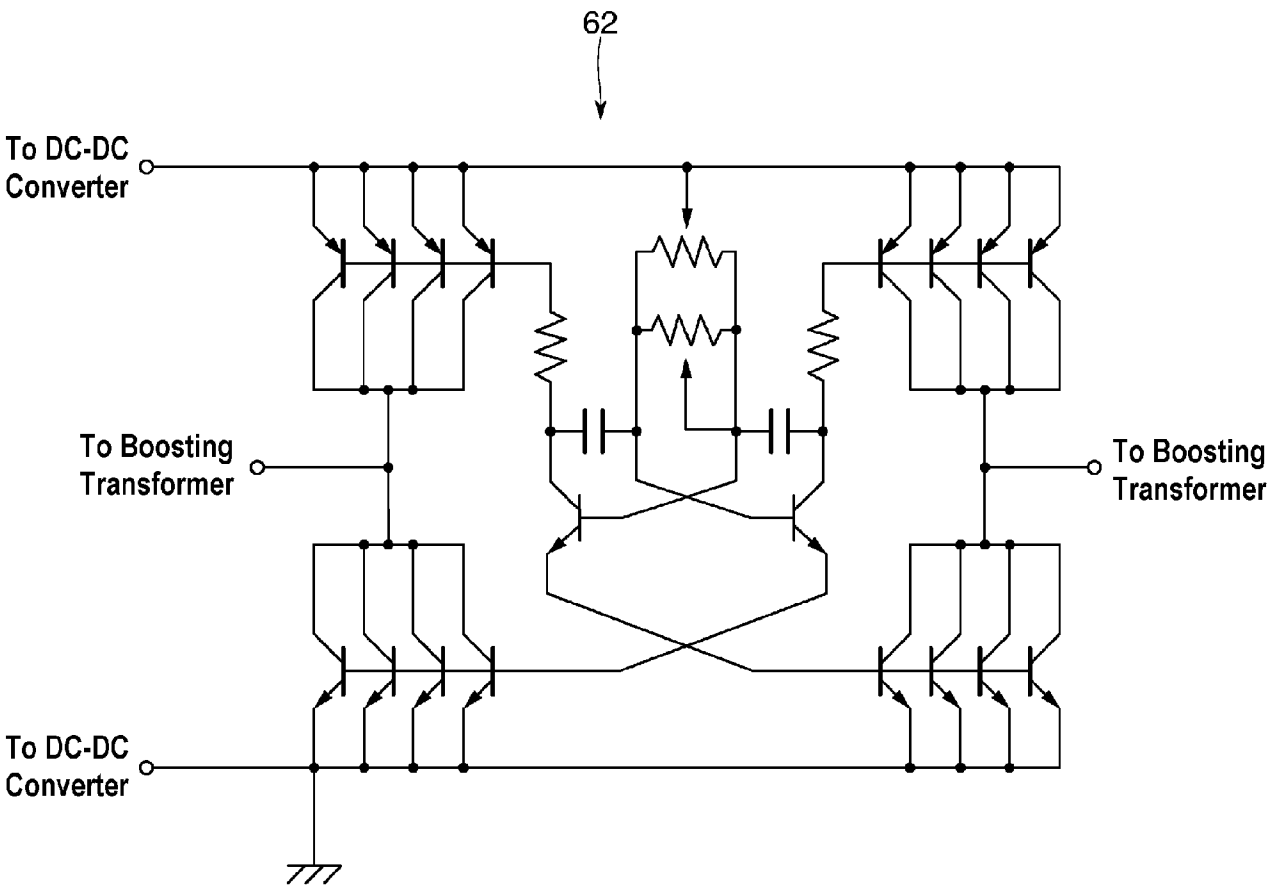
FIG. 6 is a circuit diagram of an H bridge as a constituent element of the electric field generation device according to the modified example of the present invention.

As shown in FIG. 4 or FIG. 6, the electric field generation device that generates a high frequency wave is powered by a battery and includes a circuit for converting a low DC voltage to a high AC voltage. More particularly, the circuit includes a DC-DC converter 61 that boosts a battery voltage from approximately 12 V to 300 to 500 V, an H bridge circuit 62 that converts the DC voltage outputted from the DC-DC converter 61 to an AC voltage, and a boosting transformer 63 that boosts the AC voltage outputted from the H bridge circuit 62 to a further higher voltage.

It is preferable that a first diode 64 and a second diode 65 are interposed at output ends of the electric field generation device. The first diode 64 is connected at a cathode thereof to a signal line of a secondary winding of the boosting transformer 63, and at an anode thereof to a mixer 66, which is a junction point with the ignition coil 12. The second diode 65 is connected at an anode thereof to a ground line of the secondary winding of the boosting transformer 63, and grounded at a cathode thereof. The first diode 64 and the second diode 65 serve a role to block a negative high voltage pulse current that flows in at the ignition timing from the secondary side of the ignition coil 12.

Generally, the high frequency voltage generated from the electric field generation device is applied to the central electrode of the ignition plug 13 approximately simultaneously with, immediately before, or immediately after the initiation of the spark discharge. As a result of this, a high frequency electric field is created in a space between the central electrode and the ground electrode of the ignition plug 13. Plasma is generated by causing the spark discharge to occur in the high frequency electric field, and the plasma generates a large radical plasma flame kernel that initiates flame propagation combustion.

The above description is attributed to the fact that an electron flow caused by the spark discharge and ions and radicals generated by the spark discharge vibrate and meander under the influence of the electric field, thereby increasing their travel length, and drastically increasing the number of times of collisions with ambient water molecules and nitrogen molecules. The water molecules and nitrogen molecules which have collided with the ions and radicals turn into OH radicals and N radicals. Furthermore, the ambient gas which has collided with the ions and radicals also turns into an ionized state, i.e., a plasma state, thereby drastically increasing an ignition region of the air fuel mixture and enlarging the flame kernel. As a result of this, a two-dimensional ignition merely by the spark discharge is amplified into a three-dimensional ignition, and the combustion rapidly propagates in the combustion chamber to spread at a high combustion speed.

In addition to this, during the expansion stroke in which the air fuel mixture in the combustion chamber of the cylinder 1 is ignited and combusted by the spark discharge caused to occur at the ignition plug 13, in a case in which the ECU 0 as the control device detects the deterioration of combustion state after the middle stage of the expansion stroke, the ECU 0 carries out processing of generating an high frequency electric field in the combustion chamber prior to the end of the expansion stroke, i.e., before the exhaust valve 16 is open. As a result of this, even in a case in which the combustion becomes unstable resulting from the fact that the flame is weakened or the like in the middle stage of the expansion stroke, it is possible to promote the combustion again in the same expansion stroke, and largely reduce the quantity of unburned fuel leaking out of the cylinder 1.

Specific configuration of other constituent parts can be modified without departing from the scope of the present invention.

INDUSTRIAL APPLICABILITY

The present invention is applicable to a spark ignition type internal combustion engine mounted on a vehicle or the like.

EXPLANATION OF REFERENCE NUMERALS

0 Control Device (ECU)
1 Cylinder
12 Ignition Coil
13 Ignition Plug
14, 15 Electric Field Generation Device
61, 62, 63 Electric Field Generation Device

What is claimed is:

1. A control device of a spark ignition type internal combustion engine that applies a high voltage to an ignition plug via an ignition coil, and causes a spark discharge to occur at the ignition plug, thereby igniting and combusting an air fuel mixture in a combustion chamber, while generating an electric field of a high frequency wave or emitting a microwave to generate a plasma in the combustion chamber, wherein, the control device comprises an ion current detection circuit configured to detect an ion current which flows through the ignition plug as a result of the plasma generation and the air fuel mixture combustion in the combustion chamber, the ion current being measured at a secondary side circuit of the ignition coil, the control device is configured to determine an opening timing of an exhaust valve based on a cam signal outputted from a cam angle sensor, to detect deterioration of combustion state in the combustion chamber based on the detection of the ion current flowing through the ignition plug during an expansion stroke, but prior to the opening timing of the exhaust valve, and to control an electric field generation device to generate the electric field of the high frequency wave or the microwave in the combustion chamber, the control device causes the electric field generation device to generate the electric field of the high frequency wave or the microwave in the combustion chamber approximately simultaneously with, immediately before, or immediately after the initiation of the spark discharge, and in a case in which the control device detects the deterioration of combustion state, the control device causes the electric field generation device to generate the electric field of the high frequency wave or the microwave in the combustion chamber prior to the opening timing of the exhaust valve during the expansion stroke in a cycle in which the deterioration in combustion state has been detected.

2. The ignition plug according to claim 1, wherein the ion current detection circuit is configured to measure the ion current based on a secondary voltage which is generated at a secondary winding portion of the ignition coil or at a connection end at which the microwave generation device is connected to the ignition plug.

* * * * *